US005575230A

United States Patent [19]

Eronen

[11] Patent Number: 5,575,230

[45] Date of Patent: Nov. 19, 1996

[54] TUG BOAT FOR ESCORT TOWING AND/OR HARBOR USE

[75] Inventor: Harri K. Eronen, Raisio, Finland

[73] Assignee: Aquamaster-Rauma Ltd., Rauma, Finland

[21] Appl. No.: 403,679

[22] Filed: Mar. 14, 1995

[30] Foreign Application Priority Data

Mar. 14, 1994 [FI] Finland ..... 941196

[51] Int. Cl.[6] ..... B63B 1/00

[52] U.S. Cl. ..... 114/56; 114/140; 114/253

[58] Field of Search ..... 114/56, 57, 140, 114/141, 142, 253, 254

[56] References Cited

U.S. PATENT DOCUMENTS

| | | | |
|---|---|---|---|
| 1,621,168 | 3/1927 | Kluver | 114/235 |
| 3,455,262 | 7/1969 | Weicker | 114/56 |
| 4,003,325 | 1/1977 | Allen | 114/56 |
| 4,550,673 | 11/1985 | Ingvason | 114/56 |
| 5,090,352 | 2/1992 | Stanford | 114/56 |
| 5,163,377 | 11/1992 | Calderon et al. | 114/56 |

FOREIGN PATENT DOCUMENTS

| | | |
|---|---|---|
| 0174067 | 3/1986 | European Pat. Off. . |
| 852977 | 2/1986 | Finland . |
| 2667290 | 4/1992 | France . |
| 899911 | 12/1953 | Germany . |
| 951336 | 10/1956 | Germany . |
| 2453422 | 5/1976 | Germany . |
| 1025580 | 4/1982 | U.S.S.R. . |
| 1056033 | 1/1967 | United Kingdom . |

OTHER PUBLICATIONS

"Focus on Manoeuvrability". Supplement to Marine Week, Dec., 1972, p. 48 (the illustrations).

*Primary Examiner*—Stephen Avila

*Attorney, Agent, or Firm*—Steinberg, Raskin & Davidson P.C.

[57] ABSTRACT

A tug boat for escort towing and/or harbor use having a towing winch positioned at least on the forecastle. While in escort towing, the tug is intended to improve the steering and arresting properties of a vessel to be assisted by means of a tow rope emitted from the towing winch and connected to the vessel being assisted. In harbor use, the tug boat is applied for ordinary towing and buffer tasks. In order to improve the stability of the tug boat and the towing, steering, arresting and equivalent properties provided with the tug boat in the vessel being assisted, a towing eyelet, through which the traction force of the tow rope connected from the towing winch of the forecastle to the vessel being assisted is transmitted to the tug boat, is positioned depending on the towing angle and in proximity of the deck plane or in the deck plane. The hull of the tug boat is designed such that the hydrodynamic point of application of the hull is brought up and to the front of the adjacency of the towing eyelet to reduce the torque heeling the tug boat and to bring the rope force and the hydrodynamic force longitudinally close to one another.

16 Claims, 6 Drawing Sheets

TUG BOAT FOR ESCORT TOWING AND/OR HARBOR USE

BACKGROUND OF THE INVENTION

The present invention relates to a tug boat intended for escort towing and/or for use in harbor and including at least a towing winch mounted on the fore-castle. While escort towing, the tug boat is intended to assist at high speed the steering and arresting properties of a vessel to be assisted by means of a tow rope coming from the towing winch and connected to the vessel being assisted. While working in the harbor, the tug boat can be applied to normal towing and buffering tasks.

Accidents have occurred in the immediate past, which may even have lead to major oil damages, which accelerated pressure toward improvements in safety in marine oil transports. Some of the accidents lead to oil damage which resulted from an oil tanker that lost either its steerability or propulsive thrust at a critical moment. As a consequence of such oil accidents, the requirements concerning tanker structures have been tightened, inter alia, so that a double bottom structure is required to be built in tankers. In addition, development of tug boats of a novel type has been necessary to provide assistance to and escort tankers in dangerous and coastal waters, i.e., outside of safe harbors.

Totally different standards are set for such, so-called escort tug boats compared with conventional harbor tug boats. First, the escorting speed of an escort tug boat is required to be at least as high as the lowest operating speed of a tanker. The most economical escorting speed is the highest permitted operating speed for tankers in a certain area, or, if no such limitations exist, the highest permitted speed at which the trafficking is safe. In practice, this means that the escorting speed can be even 13 to 14 knots. Accordingly, the tug boat is required at this speed to be able to carry out its escorting tasks as well as merely following the tanker at this speed. Furthermore, the escort tug boat should be able to function in all weather conditions. Such prerequisites mandate that an escort tug boat should be able to function in all conceivable directions and, if needed, it has to be able to change the direction at maximum speed. Furthermore, an escort tug boat like this is required to possess maximum traction power. In view of such requirements, the only useful propulsion apparatus in current escort tug boats is, in fact, a propeller means capable of turning around 360° and possessing a great propulsive thrust.

Primarily two types of tug boats appropriate for escort towing are known in the art, one of them being a so-called tractor tug boat in which the towing winch is positioned on the aft deck and in which the propeller means have been disposed on the front side to the towing winch, closer to the bow of the vessel. The other type is a so-called stern drive tug boat in which the towing winch is placed on the fore deck and in which the propeller means have been arranged in the stern of the vessel. The tractor tug boats and escort stern drive tug boats thus represent the state of art technology. A drawback particularly related to the stern drive tug boats is that although the lateral surface area of the hull thereof is rather large, it is not advantageous as far as its shape is concerned and the point of application of the force is located too far back so that transverse forces are difficult to achieve.

In ordinary tug boats, which are mainly intended for towing only and not for arresting, an arcuate construction provided with a hook is generally arranged on the aft deck of the tug boat to which hook, the tow rope is fastened. This construction has been found to increase the stability of the tug boat. On the forecastle of tug boats intended for arresting, no such constructions have been used.

On the other hand, a box keel or plate keel has frequently been used to improve the direction stability in ordinary vessels, but not in tug boats.

OBJECTS AND SUMMARY OF THE INVENTION

Accordingly, it is an object of the present invention to provide a novel tug boat for escort towing and/or harbor use, whereby an improvement is achieved compared with the prior art designs.

For implementing this object, in the invention, for improving the stability of the tug boat and the towing, steering, arresting and equivalent properties to be provided by a tug boat to a vessel to be assisted, a towing eyelet or equivalent is arranged through which the traction power of the tow rope connected from the towing winch of the forecastle to the vessel to be assisted is transmitted to the tug boat. The towing eyelet is positioned in accordance with the towing angle and in proximity of the deck plane or in the deck plane. The hull of the tug boat is shaped so that the hydrodynamic point of application of the hull can be provided up and before the adjacency of the towing eyelet or equivalent in order to reduce the torque heeling the tug boat and to bring the rope force and the hydrodynamic force in longitudinal direction close to one another.

With the invention, remarkable benefits are gained in comparison with designs known in the art. Of such benefits, for instance, it should be mentioned that in the tug boat, the traction point of a first traction rope of the winch wire is arranged to be mobile so that the traction point is always at an optimal point regarding the stability of the tug boat. A second significant advantage lies in that fact that the side projection of the underwater part of the tug boat is formed and made quite large that the tug boat is capable of receiving extremely powerful forces. Furthermore, the side projection of the underwater part of the vessel is in such shape that the pressure centerpoint of the projection can be arranged to be at an optimal point relative to the traction point of the winch.

Thus, in accordance with the invention, the tug boat for escort towing and/or harbor use includes a towing winch installed on its forecastle and a tow rope connected to the towing winch and to a vessel being assisted. The tug boat comprises a towing eyelet through which the tow rope is passed between the towing winch and the vessel such that the traction force of the tow rope is transmitted to the tug boat through the towing eyelet. The towing eyelet is arranged in proximity to or on a deck of the tugboat. The tug boat also includes means for moving the towing eyelet to change its position relative to a change in the towing angle and hull means for providing the hull of the tug boat with a hydrodynamic point of application in a height position close to the deck and in a longitudinal position close to the towing eyelet. In this manner, torque heeling the tug boat is reduced and the force of the tow rope and the hydrodynamic force are longitudinally close to one another. In traction situations directed to sides of the tug boat, the towing eyelet is displaced away from a centerline of the tug boat to the sides of the tug boat. The forward dimension of the bow bulging is preferably maximized, though in that for making buffering situations possible, the bow bulging is left on the aft side of the bow dimension of the tug boat.

Other advantages and characteristic features of the invention will be apparent from the detailed description of the invention.

BRIEF DESCRIPTION OF THE DRAWINGS

The following drawings are illustrative of embodiments of the invention and are not meant to limit the scope of the invention as encompassed by the claims.

FIGS. 3A, 3B, 3C and 3D–F present schematically various modes of operation of a tug boat.

DETAILED DESCRIPTION OF THE INVENTION

Figure 1:
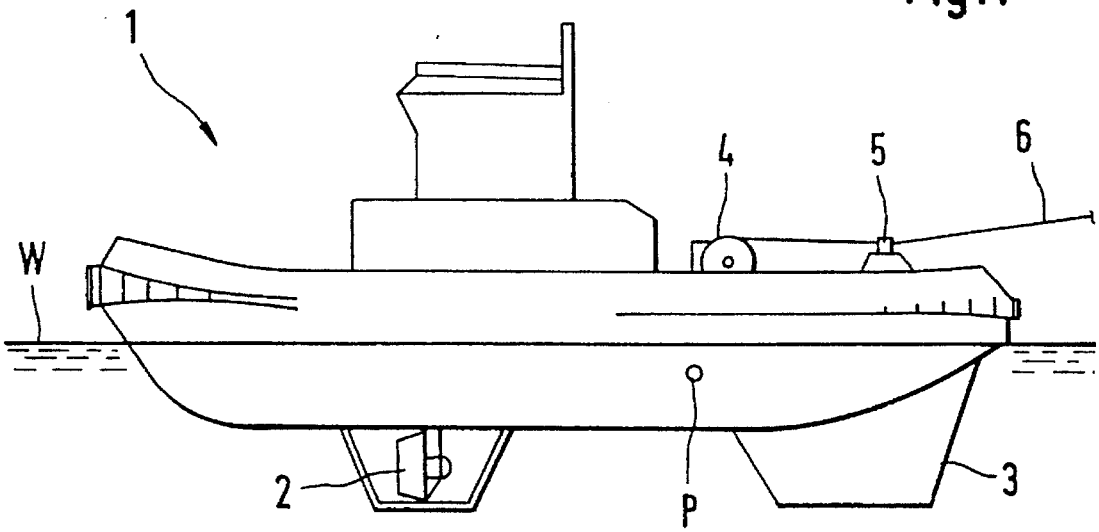
FIG. 1 presents schematically an elevational view of a tractor tug boat.

In the schematical elevational view presented in FIG. 1, a tractor tug boat is in general indicated by reference numeral 1. As shown in FIG. 1, propeller means 2 are positioned closer to the bow of the boat than the aft in the tug boat 1 and in front of a traction point 5 of a towing winch 4. A tow rope or wire is in FIG. 1 indicated by reference numeral 6 and is connected to the winch 4. In the stern of the tug boat (rear part), a large stern fin 3 is installed below the waterline W, the purpose thereof being to increase the side projection of the underwater hull profile of the tug boat such that the tug boat 1 is able to receive greater forces laterally. The purpose of the stern fin is also to improve the directional stability. In FIG. 1, the hydrodynamic point of application of the side projection is indicated by reference P. The location of the hydrodynamic point of application P is of essential importance to the traction power of the tug boat 1 and the receptivity of such forces. With regard to the traction power and the receptivity of the forces, the most important factors are the longitudinal and height-directional distance of the propeller means 2 from the traction point 5, as well as the longitudinal and height-directional distance of the hydrodynamic point of application P from the traction point 5. These dimensions have a major significance considering the traction power and the stability of the tug boat.

Figure 2:
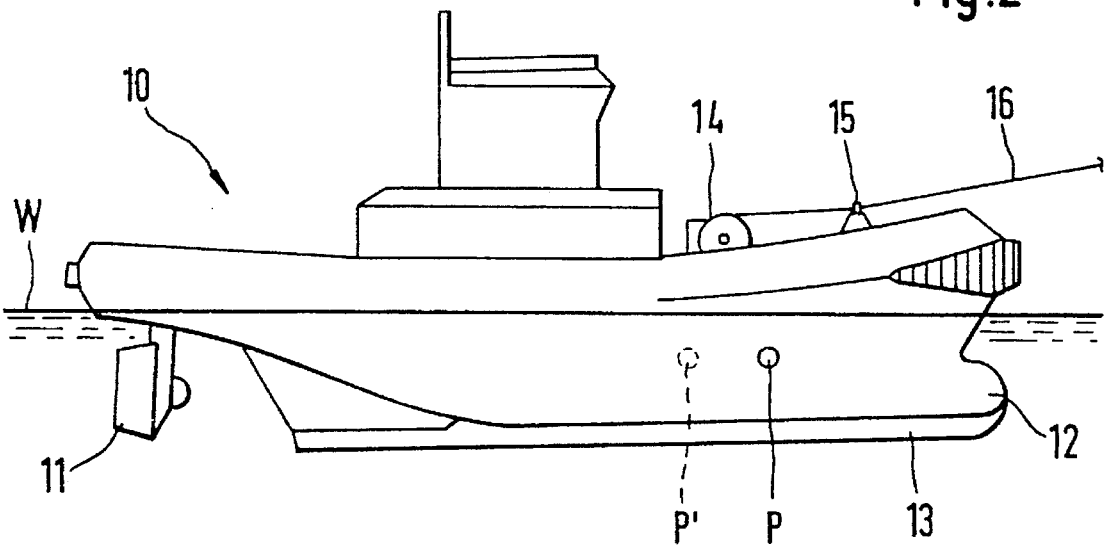
FIG. 2 presents schematically an elevational view of a stern drive tug boat of the invention.

FIG. 2 presents as a schematical elevational view a stern drive tug boat, generally indicated by reference numeral 10. In the stern drive tug boat 10, propeller 11 are positioned in the stern of the tug boat while a towing winch 14 is positioned on the forecastle of the tug boat. The traction point is indicated by reference numeral 15 and a tow rope or wire 16 is connected to the towing winch 14. In tug boat 10 as shown in FIG. 2, the transverse projection of the underwater hull profile of the tug boat is formed to be quite large since the tug boat 10 is provided with a bow bulging 12. Furthermore, an additional keel, such as box keel 13, plate keel or equivalent, is mounted under the bottom of the vessel to further increase the transverse projection of the hull profile. As a result of the bow bulging 12, the hydrodynamic point of application P of the side profile can be shifted forward, closer to the traction point 15. Reference P' depicts the point where the hydrodynamic point of application is located without a bow bulging 12. The surface of the water is indicated by reference W in FIG. 2.

It is noteworthy to point out that the locations of the hydrodynamic points of application P,P' shown in FIGS. 1 and 2 are not constant but rather shift depending on the angle of the flow entry longitudinally to the vessel. The hydrodynamic point of application P is typically located in a tractor tug boat 1, as shown in FIG. 1, between the midway and the stern of the vessel and in a stern drive tug boat 10 as shown in FIG. 2, between the midway and the bow point of the vessel. The points in the figures are presented merely by way of example.

In conjunction with the description of FIG. 2, the effect of the bow bulging 12 and the additional keel 13 in enlarging the hull profile is introduced, and therethrough, increasing lateral traction powers of the tug boat. With the aid of the bow bulging 12 and the additional keel 13, it is particularly the "force" of the hull of the vessel which increases in substantially lateral traction situations, thus adding considerably to the force without an increase in the surface area of the side profile in the same proportion. The lateral force is typically doubled even by about 10% surface area addition with the aid of the additional projections, that is, the bow bulging 12 and the additional keel 13. This results in a greater lateral force with a smaller and less expensive vessel/hull. Similarly, the point of application of the force, or the hydrodynamic point of application P can, with the aid of these projections, be kept as high as possible, whereby the heeling torque, described below, e.g., with reference to FIG. 4, and the draft remain smaller than by disposing a large-size fin of tractor tug type under the vessel hull. The effect of shifting the hydrodynamic point of application P of the bow bulging 12 forward is preferred because the rope force and the hydrodynamic force are now brought closer to one another. The force reducing the rope force of the propellers can therethrough be minimized.

Figure 2A:
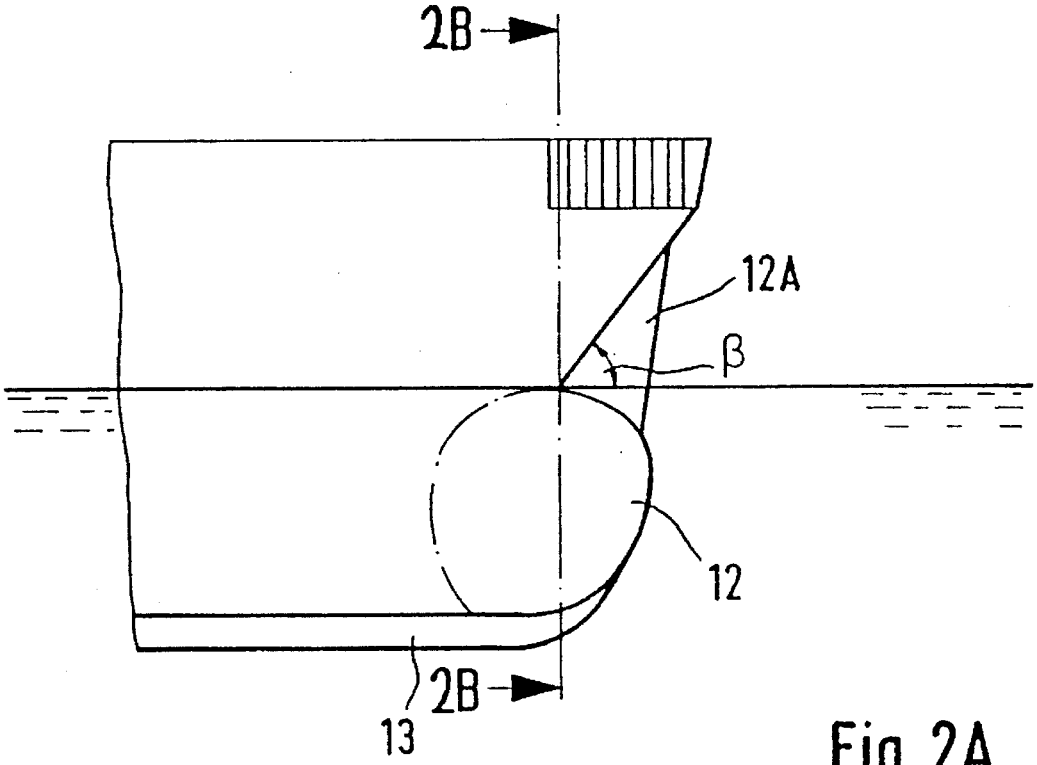
FIG. 2A illustrates schematically the bow part of the tug boat shown in FIG. 2.
Figure 2B:
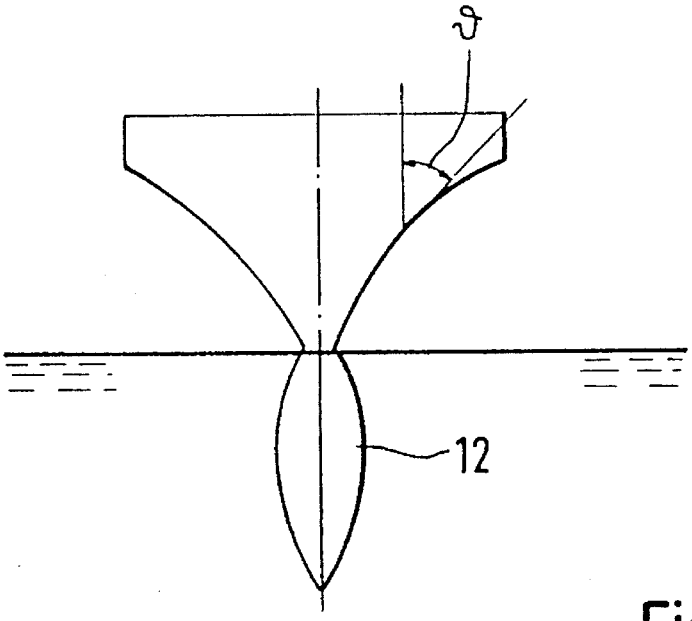
FIG. 2B is a view along the section line B—B of FIG. 2A.

FIG. 2A shows schematically the bow part of a tug boat according to FIG. 2 in order to demonstrate the design of the bow bulging 12, and FIG. 2B shows a schematical sectional view of FIG. 2A along line B—B, that is, at a point where the waterline shears the stem. As shown in FIG. 2A, the bow bulging 12 extends as far forward as possible. However, the bow bulging 12 is designed so that in buffer situations, i.e., when using the tug boat in harbor work, it remains on the rear side of the bow of the vessel. The bow bulging 12 is preferably flat, even plate-like, in order to increase the transverse force as effectively as possible. The lower edge of the bow bulging 12 is most preferably sharp-angled, and similarly the front edge and the upper edge are relatively sharp so that the flow would disengage in inclined towing situations as much as possible, thus creating maximal transverse force. The bow bulging is formed preferably lens-like, as can be seen in FIGS. 2A and 2B, so that in a normal forward driving situation it acts towards reducing the resistance and increasing the clear water speed. Similarly, the rounder shape of the bow bulging 12 makes the tug boat easier to manage when driving in the wake of the vessel being assisted.

The stem of a tug boat according to the present invention, particularly of an escort tug boat, is in steep angle to the waterline so that the angle β is, for instance, about 45° and furthermore, the bow of the vessel is formulated so that the water ejection is large, in other words, the angle γ in FIG. 2B is great, e.g. of the order of magnitude of about 45° so that water will not reach the forecastle in the roll of the sea. The power of the bow bulging 12 can be added further by arranging a plate-like section 12A between the stem and the bow bulging 12. Since the additional part 12A is plate-like, it will not impair the seaworthiness, but rather on the contrary, it increases the transverse power.

As pointed out above, an additional keel 13 is furthermore used under the bottom of the tug boat according to the invention. This additional keel 13 can be, for instance, a box keel, a plate or equivalent, or possibly a T-beam structure is appropriate for this purpose. The power effect of a T-beam-shaped or plate-like additional keel 13 is the same or even greater than with a box keel, but docking of the vessel may in such case turn out to be more problematic.

Figure 3A:
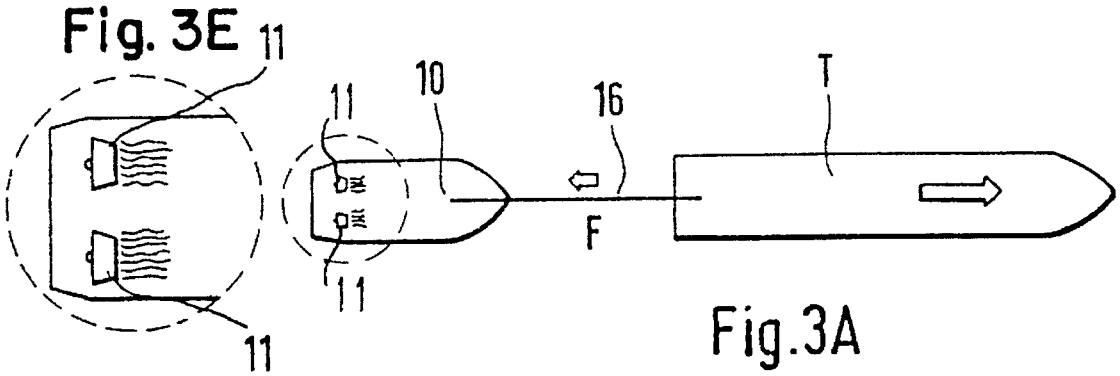
Figure 3B:
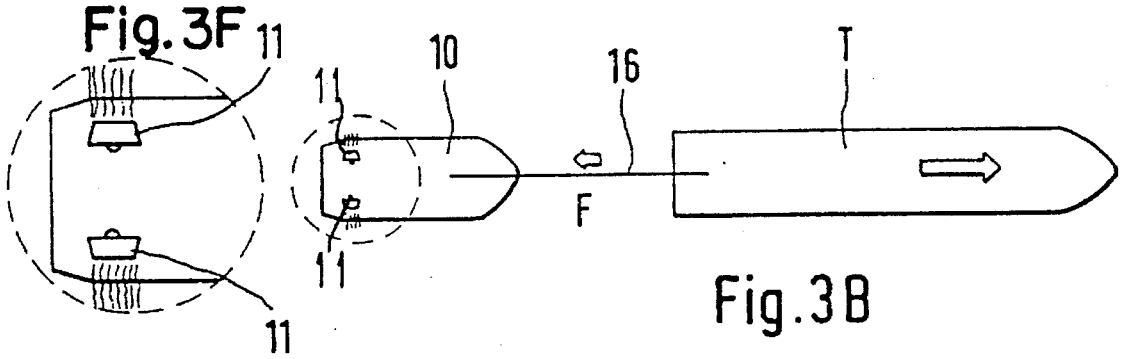

FIGS. 3A–3D illustrate various modes of operation in which the tug boat 10 of the invention is used for escort towing. FIGS. 3A and 3B illustrate the main modes of operation in which the propagation of a tanker T is arrested with a tug boat 10 and, if need be, stopped. FIG. 3A shows a situation in which the propeller means 11 of the tug boat 10 are directed so that the propulsive thrust provided thereby is in the direction of propagation. In this mode of operation, the tug boat 10 is kept in the same direction as the tow rope 16. The traction F is thus created solely with the aid of the propeller means 11. Also, in this mode of operation, the traction power F is dependent on the speed of the tanker T. The highest traction power achieved in the tests was about 1.5 to 1.6 times the static traction power of the tug boat. However, as mentioned above, this mode of operation cannot be used at very high speeds because when the traction power is provided solely with the aid of the propellers, the engine of the tug boat 10 will be excessively overloaded when the speed of the tanker T becomes high enough. If such excessive overloading occurs, the tug boat 10 must be turned from the position shown in FIG. 3A.

FIG. 3B shows a second mode of operation in which the tug boat 10 is used for direct arresting and holding of the tanker T. This mode of operation differs from the one shown in FIG. 3A in that the propeller means 11 are turned 90° relative to the travelling direction of the tug boat 10 so that the propeller means 11 face each other. When the engines are running idle in this mode of operation, the arresting effect provided by the tug boat 10 is insignificant. However, when the engines of the tug boat 10 are run at full speed, the arresting effect is, even at a very low speed (about 8 knots), equal to the highest static traction power obtainable with the tug boat 10. This has been proved in the tests results of the invention. However, when the speed increases, the arresting effect also increases substantially linearly. There is no similar risk when using this mode of operation to overload the engines as there is when using the mode of operation shown in FIG. 3A. Hence, the mode of operation shown in FIG. 3B can be used effectively at high speeds. A second remarkable advantage achieved with this mode of operation is that hardly any side thrust component is created in the tug boat 10, so that the arresting or reduction in speed will not interfere with the steering of the vessel being assisted, e.g., the tanker T.

Figure 3C:
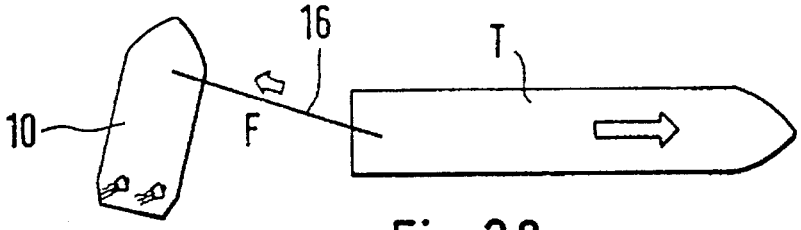

FIG. 3C illustrates a mode of operation in which the tug boat 10 has been turned mainly in transverse direction to the tow rope 16. This mode of operation is a so-called dynamic mode of operation, and therethrough, an excellent and powerful arresting and steering effect can be obtained, particularly if the side projection of the underwater hull profile of the tug boat is sufficient. Therein, the arresting effect is provided particularly with the aid of the hull of the tug boat 10. It is especially important in this mode of operation that the stability of the tug boat is of great importance because if the location of the traction point of the tug boat 10 relative to the pressure centerpoint of the side projection of the underwater hull profile of the tug boat is poor, the tug boat may even capsize. As mentioned in the foregoing, this mode of operation can be used particularly when steering a tanker T being assisted with the equipment of its own is difficult or impossible, whereby it is with tug boat 10 that the tanker T can be kept in desired direction.

Figure 3D:
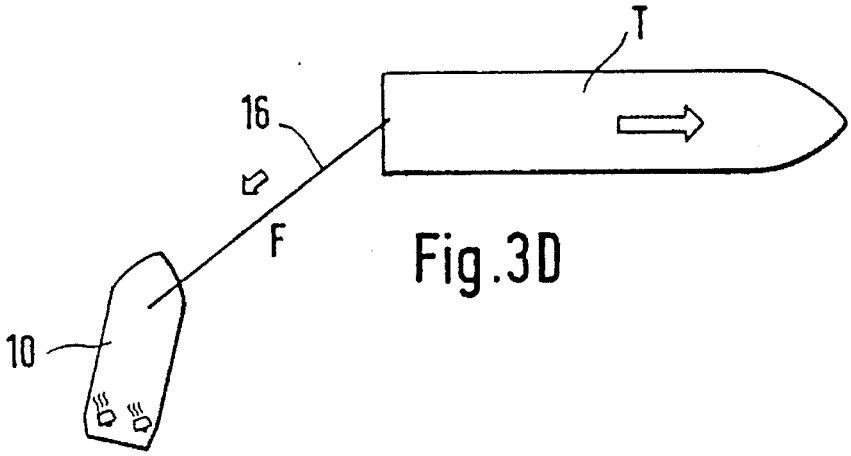

A towing angle α is defined between the longitudinal center line of the boat 10 represented by a dashed line in FIGS. 3C and 3D and the tow rope 16. The towing eyelet is movable to change its position relative to a change in the towing angle α.

FIG. 3D illustrates a mode of operation which is, in a way, a combination of the modes of operation of direct arresting and of dynamic steering. In this mode of operation, both the hull of the tug boat 10 and the propeller means 11 are used to assist in arresting, and in addition, with the mode of operation, the tanker T being assisted is steered as shown in FIG. 3C. With regard to safety concerns, the mode of operation presented in FIG. 3D is preferred to the design shown in FIG. 3C because the stability of the tug boat in this mode of operation is superior.

As may become obvious from FIGS. 3A–3D, the tug boat is required to be able to provide traction force in a number of different directions relative to the length of the tug boat 10. In addition, as described above, the stability of the tug boat 10 in certain situations, while in operation, is problematic when traction is directed at the tug boat 10 from a difficult direction.

Figure 4:
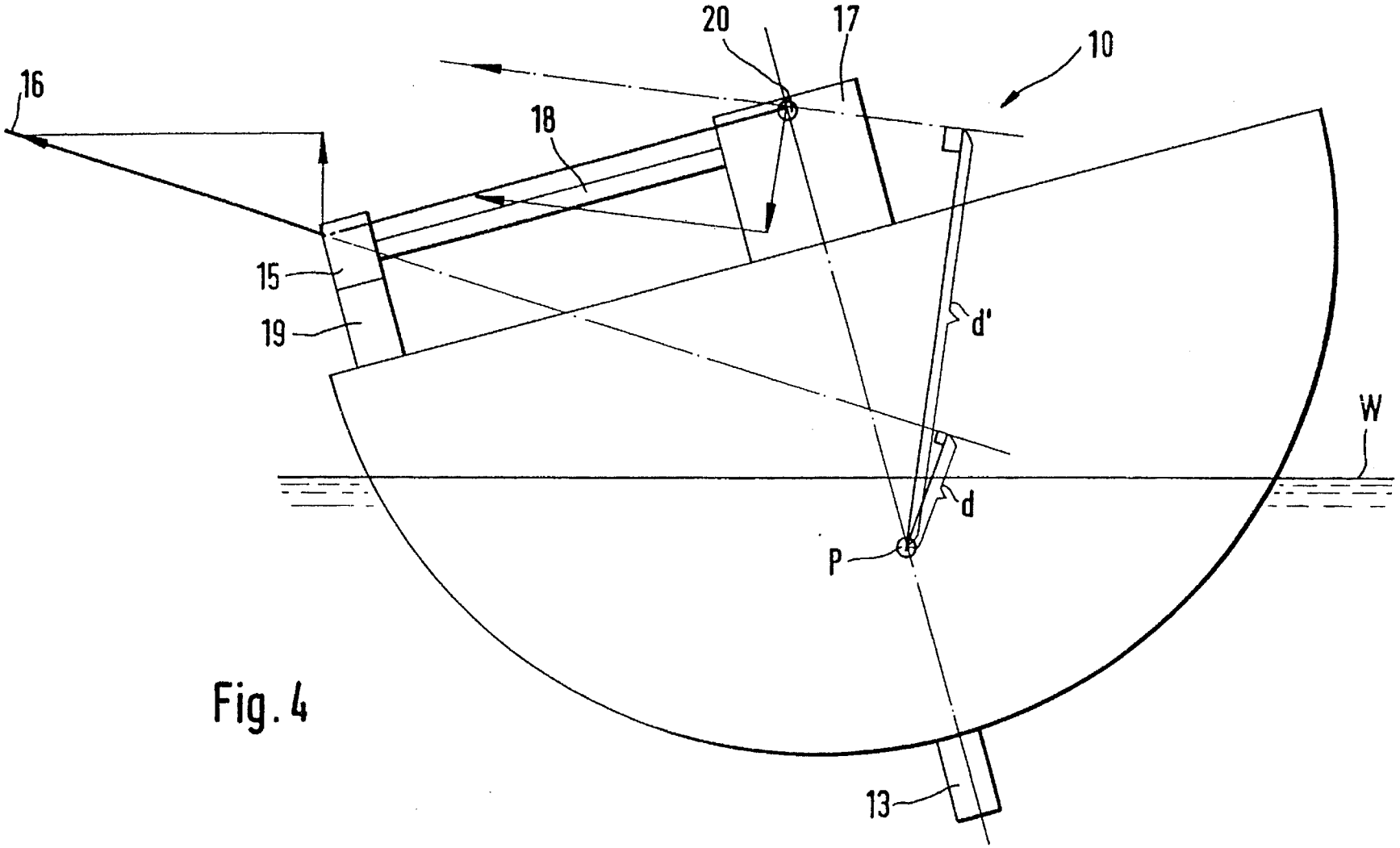
FIG. 4 presents schematically a view of a tug boat in a traction situation when viewed in the longitudinal axis direction of the tug boat.
Figure 5:
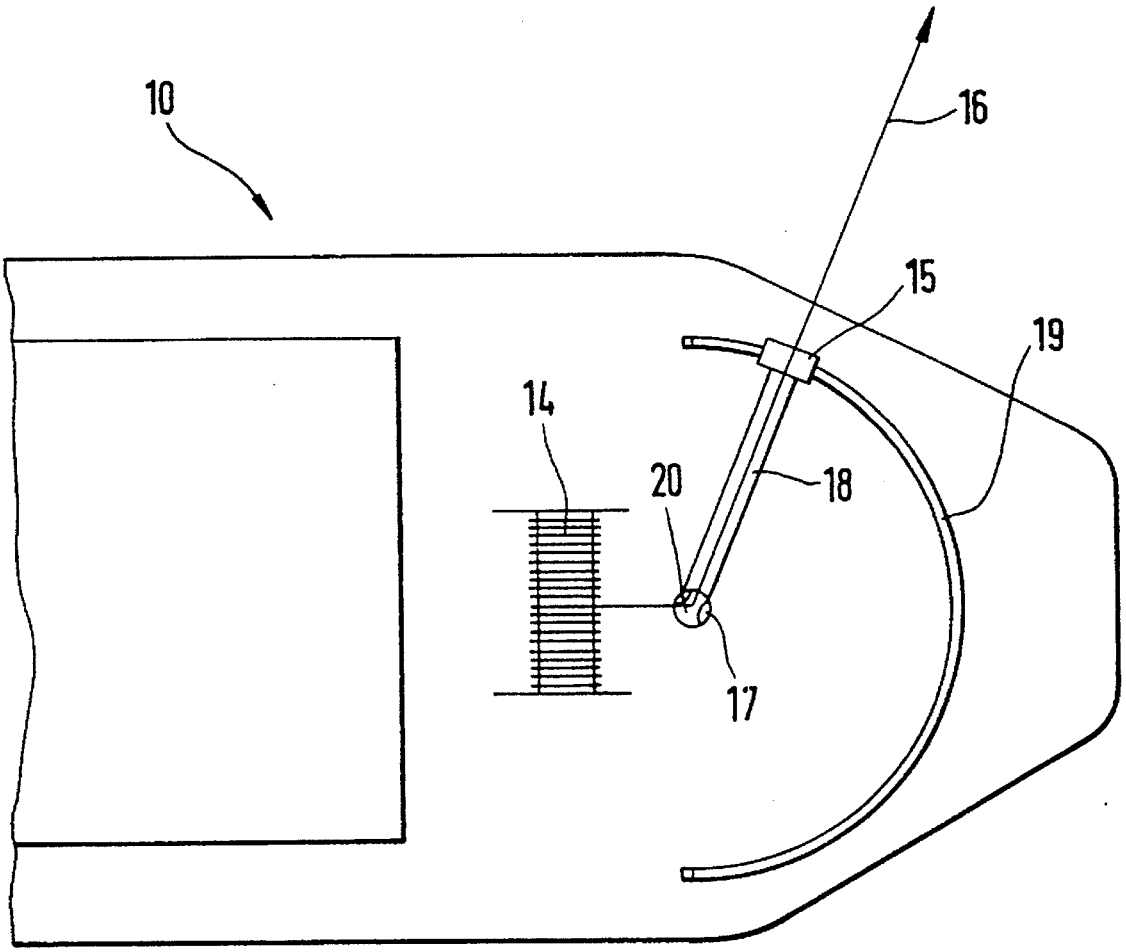
FIG. 5 presents schematically in top view a traction arrangement of a tug boat in accordance with the invention.

In FIGS. 4 and 5, a design is illustrated by which the stability of the tug boat 10 is improved in difficult situations. FIG. 4 illustrates a tug boat 10 in longitudinal direction and FIG. 5 illustrates tug boat 10 schematically in top view so that in both figures the traction is directed at the tug boat laterally.

As shown in FIGS. 4 and 5, the stability of the tug boat is improved by, on a deck of a tug boat 10 (either on fore deck or aft deck, or even on both decks) mounting a tow arc 19 which is comprised of a tubular or rail structure or equivalent. The tow arc 19 is most advantageously circular in shape, as shown in FIG. 5. As shown in FIG. 5, the tow arc 19 has a first end mounted to a first side of the deck of the boat and a second end mounted to a second side of the deck of the boat and as shown in FIG. 4, the tow arc 19 is arranged in a plane substantially parallel to the plane of the deck. On the tow arc 19, a sledge, a slide, or equivalent towing eyelet 15 is positioned to be movable along the tow arc, and through which eyelet 15, a tow rope 16 is arranged to pass so that the towing eyelet 15 creates a traction point from which the tow rope 16 passes to the vessel to be assisted. The tow rope 16 passes from the towing winch 14 into the towing eyelet 15 through a steering runner 20 which is most preferably located in the centerpoint of the tow arc 19 or substantially within the range of the centerpoint. The structure is preferably constructed such that the steering runner 20 is formed in a vertical shaft 17 on which a horizontal beam 18 is mounted and, on the outer end of the horizontal beam 18, the towing eyelet 15 is installed. This will stiffen and stabilize the structure even more. The tow arc 19 is arranged most advantageously in the plane of the deck in that the towing eyelet or loop 15 passes as close to the deck of the tug boat 10 as possible, the purpose thereof being to provide the traction point as low as possible.

The effect and advantage to be gained by means of the structure shown in FIGS. 4 and 5 are most obvious from a view of FIG. 4. As depicted in FIG. 4, the tow rope 16 passes from the towing winch 14 to the towing eyelet 15 either direct or via the steering runner 20. The distance of the line of action of the traction force exerting an influence on the tow rope 16 from the hydrodynamic point of application P of the side projection of the underwater hull profile of the tug boat is indicated by reference d in FIG. 4. Reference d' refers to distance from the hydrodynamic point of application P in an instance in which the traction point of the tow rope would be located in the steering loop 20. The distance d', which constitutes a lever arm to the traction force acting on the tow rope, is considerably greater than distance d, whereby in these two instances, the torque capsizing the tug boat 10 is considerably smaller when using the tow arc 19 of the invention than without any tow arc. If the tug boat 10 heeled further from what is presented in FIG. 4, the line of action of the traction force affecting the tow rope 16 would move even closer to the hydrodynamic point of application P or even to the opposite side thereof. In such case, the traction power would no longer possess the tendency to capsize the tug boat but instead, it would attempt to straighten the tug boat. As discussed above, the design shown in FIGS. 4 and 5 is particularly advantageous, especially in inclined towing situations as shown in FIGS. 3C and 3D.

Figure 6:
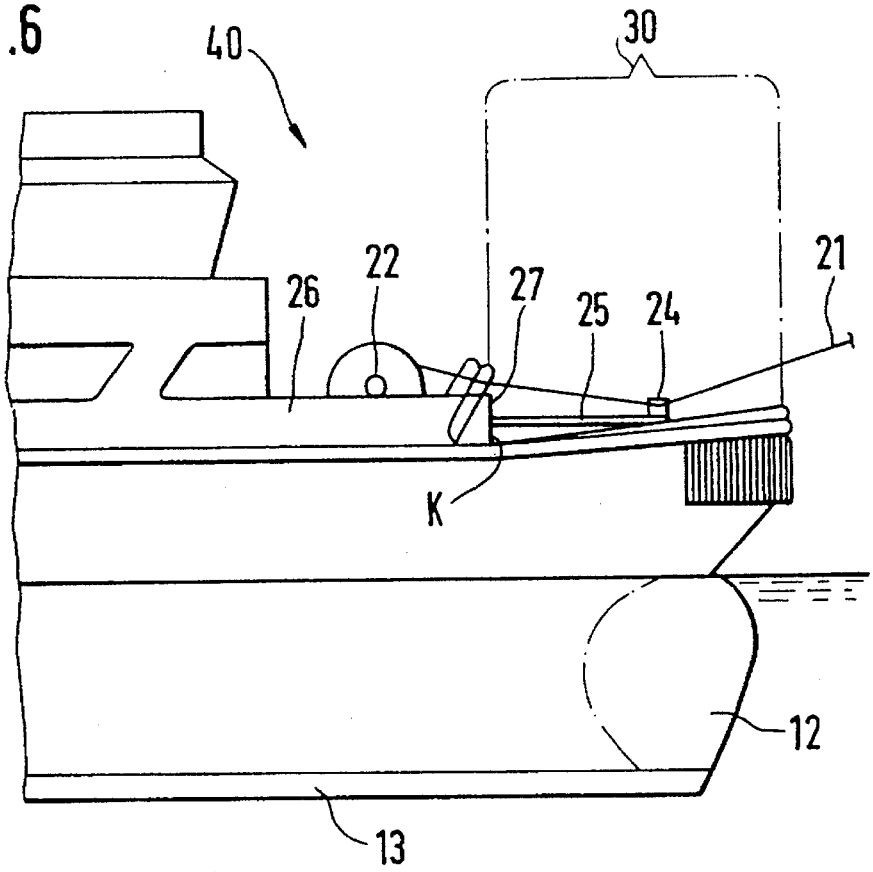
FIG. 6 presents schematically in side view a part of a tug boat provided with an advantageous embodiment of the traction arrangement in accordance with the invention.
Figure 7:
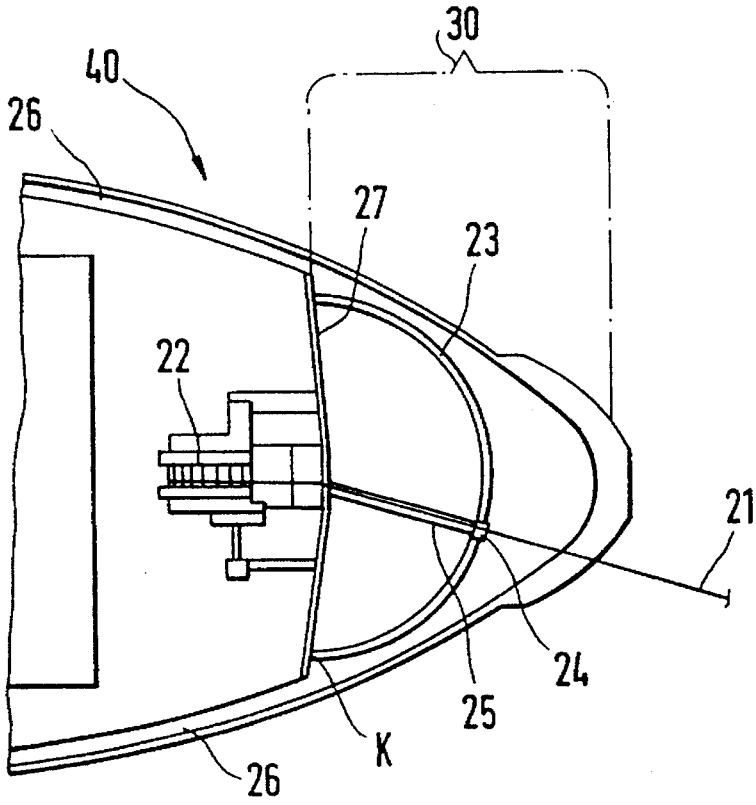
FIG. 7 is a top view of the part of a tug boat provided with an advantageous embodiment of the traction arrangement as shown in FIG. 6.

FIGS. 6 and 7 illustrate an advantageous embodiment of the traction arrangement of the invention, whereby the traction arrangement is positioned on the forecastle of a vessel, i.e., a tug boat 40. As shown in FIGS. 6 and 7, a tow arc 23 is disposed in a front part 30 of the forecastle, this being in its entirety reserved for the tow arc 23 so that no other constructions are arranged within this area. The front part 30 of the forecastle is not provided with any reel, neither is the area intended to be moved upon. By this arrangement, the tow arc 23 can be arranged as low as possible. The arrangement may also be applied on the aft deck of the tug boat in similar fashion.

A bulwark 26 of the vessel 40 terminates in the bow in the rear part of the tow arc 23, and it is drawn transversely in the form of transverse bulwark 27 across the forecastle to define a space for a winch 22 and the rear part of the forecastle. The tow arc 23 is preferably arranged to be shifted hydraulically aside (not shown), so that passing a tow rope 21 through the eyelet 24 in the tow arc 23 can be performed without having to cross the transverse bulwark 27 to the front part 30 of the forecastle. The side view shown in FIG. 6 demonstrates that the front part 30 of the forecastle rises towards the bow up so that a freeboard can be added on the bow of the vessel 40. This will not impair the heeling tendency of the vessel 40 because in inclined towing situations, the tow rope 21 is directed to the side in the rear part of the tow arc 23 at point K which is located more below than the bow.

In the embodiment of the traction arrangement in which a horizontal beam or equivalent steering rod 25 is used in association with the tow arc 23, a roller arrangement or equivalent measurement tools (not shown) for measuring the traction power of the tow rope 21 can readily be connected thereto. Placing such measurement tools on a free tow rope 21 is quite difficult to implement.

Reference is made to a corresponding U.S. patent application filed simultaneously herewith, and which corresponds to Finnish Patent Application No. 941195, in which additional details of measurement tools as well as arrangements for moving the towing eyelet along the tow arc are described in detail.

The examples provided above are not meant to be exclusive. Many other variations of the present invention would be obvious to those skilled in the art, and are contemplated to be within the scope of the appended claims.

I claim:

1. A tug boat for escort towing and/or harbor use including an elongate hull, a towing winch installed on a deck thereof and a tow rope connected to the towing winch and connectable to a vessel being assisted, comprising a towing eyelet through which the tow rope is passed between the towing winch and connectable to the vessel such that traction force of the tow rope is transmitted to the tug boat through said towing eyelet, said towing eyelet being arranged such that the force transmitted to the tug boat through the tow rope lies in a plane in proximity to or on the deck of the tug boat, and a substantially arcuate tow arc mounted on the deck and arranged in a plane substantially parallel to a plane of the deck, said towing eyelet being movable along said tow arc to change its position relative to a change in a towing angle defined between a longitudinal center line of the boat and a direction of the tow rope extending from the boat to the vessel, the hull having a construction such that a hydrodynamic point of application of the hull is situated in a longitudinal position proximate to said towing eyelet such that torque heeling the tug boat is reduced and the force of the tow rope and the hydrodynamic force are longitudinally close to one another.

2. The tug boat of claim 1, wherein said tow arc is mounted on the forecastle of the tug boat, said towing eyelet being coupled to said tow arc.

3. The tug boat of claim 2, wherein in traction situations directed to sides of the tug boat, said towing eyelet is displaced away from a centerline of the tug boat to the sides of the tug boat.

4. The tug boat of claim 1, wherein said hull construction comprises a bow bulging projecting forward from the stem of the tug boat.

5. The tug boat of claim 4, wherein the forward dimension of the bow bulging is maximized, though in that for making buffering situations possible, the bow bulging is left on the aft side of the bow dimension of the tug boat.

6. The tug boat of claim 4, wherein said bow bulging is flat to increase the transverse force of the tug boat.

7. The tug boat of claim 4, wherein said bow bulging is lens-like in shape.

8. The tug boat of claim 4, wherein said bow bulging is plate-like.

9. The tug boat of claim 4, wherein said hull construction further comprises a plate-like additional part installed between said bow bulging and the stem of the tug boat, said additional part improving the power of said bow bulging and increasing further the transverse force.

10. The tug boat of claim 4, wherein said hull construction further comprises an additional keel mounted on a bottom of the tug boat.

11. The tug boat of claim 10, wherein said additional keel is a box keel, plate keel or T-beam keel.

12. The tug boat of claim 1, wherein the towing winch is installed on the forecastle of the boat.

13. The tug boat of claim 1, wherein the towing winch and said tow arc are stationarily, fixedly mounted to the deck.

14. The tug boat of claim 1, wherein said tow arc has a first end mounted to a first side of the deck of the boat and a second end mounted to a second side of the deck of the boat, said towing eyelet being movable about a center of curvature of said tow arc between said first and second ends to enable the tow rope to extend over both said first and second sides of the boat.

15. The tug boat of claim 1, wherein said towing eyelet is arranged on the bow of the boat and said hull construction comprises a bow bulging for increasing a transverse profile of the hull of the tug boat at the bow such that the hydrodynamic point of application is close to the bow and thus said towing eyelet.

16. A tug boat for escort towing and/or harbor use including an elongate hull, a towing winch installed on a deck thereof and a tow rope connected to the towing winch and connectable to a vessel being assisted, comprising a towing eyelet through which the tow rope is passed between the towing winch and connectable to the vessel such that traction force of the tow rope is transmitted to the tug boat through said towing eyelet, said towing eyelet being arranged such that the force transmitted to the tug boat through the tow rope lies in a plane in proximity to or on the deck of the tug boat, said towing eyelet being movable to change its position relative to a change in a towing angle defined between a longitudinal center line of the boat and a direction of the tow rope extending from the boat to the vessel, the hull having a construction such that a hydrodynamic point of application of the hull is situated in a longitudinal position proximate to said towing eyelet such that torque heeling the tug boat is reduced and the force of the tow rope and the hydrodynamic force are longitudinally close to one another, said hull construction comprising a bow bulging projecting forward from the stem of the tug boat, the forward dimension of said bow bulging being maximized and said bow bulging being positioned on the aft side of the bow dimension of the tug boat for making buffering situations possible.

* * * * *